US012421809B2

(12) United States Patent
Eitschberger et al.

(10) Patent No.: US 12,421,809 B2
(45) Date of Patent: Sep. 23, 2025

(54) TOOL HOUSING FOR USE IN A WELLBORE TOOL STRING

(71) Applicant: DynaEnergetics Europe GmbH, Troisdorf (DE)

(72) Inventors: Christian Eitschberger, Munich (DE); Atakan Sever, Troisdorf (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 18/553,376

(22) PCT Filed: Apr. 11, 2022

(86) PCT No.: PCT/EP2022/059658

§ 371 (c)(1),
(2) Date: Sep. 29, 2023

(87) PCT Pub. No.: WO2022/218937

PCT Pub. Date: Oct. 20, 2022

(65) Prior Publication Data

US 2024/0209696 A1 Jun. 27, 2024

Related U.S. Application Data

(60) Provisional application No. 63/173,616, filed on Apr. 12, 2021.

(51) Int. Cl.
*E21B 17/046* (2006.01)
*E21B 43/119* (2006.01)

(52) U.S. Cl.
CPC ..... *E21B 17/0465* (2020.05); *E21B 43/119* (2013.01)

(58) Field of Classification Search
CPC ..... E21B 17/0465; E21B 43/119
See application file for complete search history.

(56) References Cited

U.S. PATENT DOCUMENTS 3,297,344 A * 1/1967 Hanes ..... E21B 33/038 285/321
3,345,085 A * 10/1967 Hanes ..... F16L 37/0885 285/321

(Continued)

FOREIGN PATENT DOCUMENTS

CN 203614083 U 5/2014
CN 206190271 U 5/2017
CN 108661609 A 10/2018

OTHER PUBLICATIONS

Schlumberger, "Fractal Flex: Multistage Stimulation Perforating System", 2018, 1 page.

(Continued)

*Primary Examiner* — D. Andrews
(74) *Attorney, Agent, or Firm* — Womble Bond Dickinson (US) LLP

(57) ABSTRACT

A tool housing for use in a wellbore tool string may include a housing body having a first housing region and a second housing region. The tool housing may include a bias member channel provided in the first housing region and extending inward in a radial direction. A bias member may be provided within the bias member channel and engaged with a snap connector. The bias member may bias the snap connector outward in the radial direction. A connector groove may be provided in a hollow interior of the second housing region and extend outward in the radial direction. A first housing region of a second tool housing of a wellbore tool string may be inserted into a hollow interior of a first tool housing. A snap connector of the second tool housing may be coupled with a connector groove of the first tool housing.

7 Claims, 14 Drawing Sheets

(56) References Cited

U.S. PATENT DOCUMENTS

| | | | | |
|---|---|---|---|---|
| 3,718,350 | A * | 2/1973 | Klein | F16L 37/0885 285/321 |
| 4,603,886 | A * | 8/1986 | Pallini, Jr. | F16L 37/088 285/308 |
| 4,830,408 | A * | 5/1989 | Reimert | E21B 17/08 285/308 |
| 4,850,438 | A * | 7/1989 | Regalbuto | E21B 43/117 175/4.6 |
| 5,020,591 | A | 6/1991 | Shore | |
| 6,851,471 | B2 | 2/2005 | Barlow et al. | |
| 8,408,286 | B2 | 4/2013 | Rodgers et al. | |
| 2003/0155112 | A1 | 8/2003 | Tiernan et al. | |
| 2012/0247771 | A1 | 10/2012 | Black et al. | |
| 2017/0219141 | A1 | 8/2017 | Morrison | |
| 2019/0234188 | A1 | 8/2019 | Goyeneche | |
| 2019/0257158 | A1* | 8/2019 | Langford | E21B 17/043 |

OTHER PUBLICATIONS

GEODynamics "VaporGun", www.perf.com/vaporgun; 2020; 4 pages.
European Searching Authority; International Search Report and Written Opinion issued in PCT/EP2022/059658 dated Sep. 19, 2022; 19 pages.

* cited by examiner

TOOL HOUSING FOR USE IN A WELLBORE TOOL STRING

CROSS-REFERENCE TO RELATED APPLICATIONS

This application is a national stage application of International Patent Application No. PCT/EP2022/059658 fled Apr. 11, 2022, which claims priority to U.S. Provisional Application No. 63/173,616 filed Apr. 12, 2021, the entire contents of each of which is incorporated herein by reference in its entirety.

BACKGROUND

Wellbore tools used in oil and gas operations, including perforating guns that house shaped charges, are often sent down a wellbore, configured as tool strings connected together to reduce time and costs associated with the operation.

Running a tool string into a wellbore can be an expensive and time-consuming operation. Additionally, the length of a wellbore tool string may be limited by the height of surface hardware and equipment, which must accommodate the full length of the tool string prior to insertion into the wellbore. Accordingly, reducing the length of individual tools within the tool string, i.e., length optimization, may allow for more perforating guns to be included in a tool string. Thus, more stages can be perforated in a single wireline run, resulting in increased efficiency and/or reduced operational costs. Accordingly, it may be desirable to develop shorter tool housings to achieve greater length optimization in the tool string.

Additionally, wellbore operations may be time-consuming and labor-intensive. Accordingly, it may be desirable to develop tool housings that may be efficiently and securely coupled together, in order to improve reliability of the tool string and improve operational efficiency in assembling the tool string.

Additionally, in certain applications, it may be desirable to make perforations in a wellbore in a particular orientation. Accordingly, it may be desirable to develop tool housings that allow a user to quickly and easily ensure proper alignment of adjacent wellbore tools in the tool string.

BRIEF SUMMARY

According to an aspect, the exemplary embodiments include a tool housing for use in a wellbore tool string. The tool housing may include a housing body extending in an axial direction and including a first housing region having a first outer diameter, and a second housing region having a second outer diameter. The second outer diameter may be larger than the first outer diameter. The tool housing may include a bias member channel provided in the first housing region and extending inward in a radial direction from a first outer surface of the first housing region. A bias member may be provided within the bias member channel. A snap connector may be engaged with the bias member such that the bias member biases the snap connector outward in the radial direction. A hollow interior may be provided within the second housing region and being bound by a hollow interior surface. A hollow interior diameter of the hollow interior may be greater than or equal to the first outer diameter. A connector groove may extend outward in the radial direction from the hollow interior surface, and may have a groove diameter that is greater than the hollow interior diameter and less than the second outer diameter. A release opening may extend from a second outer surface of the second housing region to the connector groove.

In another aspect, the exemplary embodiments include a method for assembling a wellbore tool string for perforating a subterranean hydrocarbon-bearing reservoir. The method includes providing a first tool housing including a housing body extending in an axial direction and having a first housing region having a first outer diameter and a second housing region having a second outer diameter, wherein the second outer diameter is larger than the first outer diameter. The first tool housing includes a hollow interior provided within the second housing region and bound by a hollow interior surface having a hollow interior diameter greater than or equal to the first outer diameter. The method includes providing a second tool housing having a housing body extending in an axial direction and including a first housing region with a first outer diameter and a second housing region with a second outer diameter, wherein the second outer diameter is larger than the first outer diameter. A snap connector is provided on the second housing region and biased outward in the radial direction. The method includes positioning the first housing region of the second housing tool proximate to the hollow interior of the first tool housing, inserting the first housing region of the second tool housing into the hollow interior of the first tool housing, and coupling the second tool housing with the first tool housing.

In a further aspect, the exemplary embodiments include a wellbore tool connection assembly. The wellbore tool connection assembly may include a tool housing having a first housing region having a first outer diameter, and a second housing region having a second outer diameter. The second outer diameter may be larger than the first outer diameter. A bias member channel may be provided in the first housing region and extend inward in a radial direction from a first outer surface of the first housing region. A bias member may be provided within the bias member channel. A snap connector may be engaged with the bias member such that the bias member biases the snap connector outward in the radial direction. A recess may extend inward in the radial direction from the first outer surface of the first housing region. The recess may be bound by a recess wall. A retainer screw may be engaged with the snap connector and extend inward in a radial direction into the recess such that the bias member biases the retainer screw against the recess wall.

BRIEF DESCRIPTION OF THE SEVERAL VIEWS OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1:
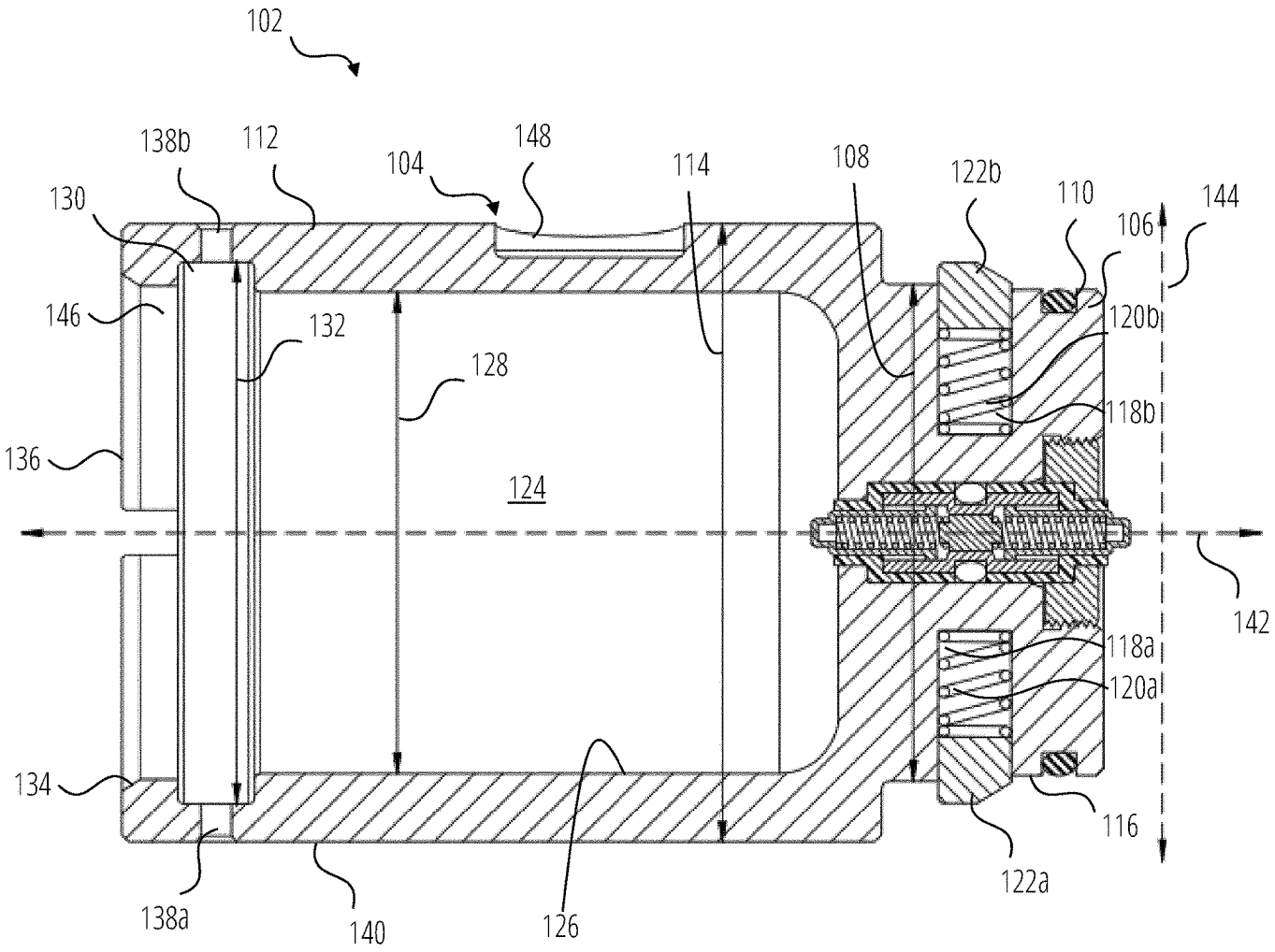
FIG. 1 is a cross-section view of a tool housing according to an exemplary embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

DETAILED DESCRIPTION

Reference will now be made in detail to exemplary embodiments. Each example is provided by way of explanation and is not meant as a limitation and does not constitute a definition of all possible embodiments.

FIG. 1 illustrates a cross-section view of an exemplary embodiment of a tool housing 102. The tool housing 102 may include a housing body 104 that extends along an axial direction 142. The housing body 104 may include a first housing region 106 having a first outer diameter 108 and a second housing region 112 having a second outer diameter 114. The second outer diameter 114 may be larger than the first outer diameter 108. A seal element 110, such as an o-ring, may be provided on a first outer surface 116 of the first housing region 106. One or more scallops 148 may be formed on a second outer surface 140 of the second housing region 112.

Bias member channels 118*a*, 118*a* may be provided in the first housing region 106. The bias member channels 118*a*, 118*a* may extend inward in a radial direction 144 from the first outer surface 116 of the first housing region 106.

Bias members 120*a*, 120*b* may be provided within the bias member channels 118*a*, 118*b*. The bias members 120*a*, 120*b* may be a spring member such as a coil spring, leaf spring, or other suitable structure. Snap connectors 122*a*, 122*b* may be engaged with the bias members 120*a*, 120*b* such that the bias members 120*a*, 120*b* bias the snap connectors 122*a*, 122*b* outward in the radial direction 144. At least a portion of the snap connectors 122*a*, 122*b* may be provided within the bias member channels 118*a*, 118*b*, and at least a portion of the snap connectors 122*a*, 122*b* may protrude from the bias member channels 118*a*, 118*b*.

In an exemplary embodiment, the snap connectors 122*a*, 122*b* may include grooves, inlets, minor through bores, or the like extending through the body of the snap connector in the radial direction 144. These structures may be configured to allow fluid communication between the bias member channels 118*a*, 118*a* and an exterior environment, such as the wellbore, thus facilitating pressure equalization during wellbore operations. This configuration may help to prevent disengagement of the snap connectors 122*a*, 122*b* due to hydrostatic pressure in the wellbore.

The second housing region 112 may include a hollow interior 124 provided within the second housing region 112. The hollow interior 124 may be bound at least in part by a hollow interior surface 126. The hollow interior 124 may include a hollow interior diameter 128 that is greater than or equal to the first outer diameter 108. The hollow interior 124 may open to an exterior space at an open end 136.

The second housing region 112 may further include a connector groove 130 extending outward from the hollow interior surface 126 in the radial direction 144. The connector groove 130 may have a groove diameter 132 that is larger than the hollow interior diameter 128 and smaller than the second outer diameter 114. In an exemplary embodiment, the connector groove 130 may extend around a full circumference of the hollow interior surface 126. However, the disclosure is not limited to this embodiment. For example, the connector groove 130 may be configured as a plurality of discrete grooves spaced around the circumference of the hollow interior surface 126 and corresponding to angular positions of the snap connectors 122*a*, 122*b*.

The second housing region 112 may further include an inlet chamfer 134 provided at the open end 136. The inlet chamfer 134 may slope inward in the radial direction 144 from the open end 136 toward the connector groove 130. There may be a space 146 provided between the inlet chamfer 134 and the connector groove 130 in the axial direction 142, or, alternatively, the inlet chamfer 134 may be axially adjacent to the connector groove 130.

The second housing region 112 may further include release openings 138*a*, 138*b*. The release openings 138*a*, 138*b* may each extend from the second outer surface 140 of the second housing region 112 to the connector groove 130. In an exemplary embodiment, a total number of the release openings 138*a*, 138*b* will be equal to a total number of the snap connectors 122*a*, 122*b* such that the release openings are in one-to-one correspondence with the snap connectors.

In an exemplary embodiment, the release openings 138*a*, 138*b* and the snap connectors 122*a*, 122*b* may intersect with a common plane that includes a central axis of the tool housing 102 (the central axis may be represented by the broken line indicating the axial direction 142 in FIG. 1). For example, given that FIG. 1 represents a cross-section view of the tool housing 102, it can be easily seen that the plane defining the cross-section intersects with the snap connectors 122*a*, 122*b* and the release openings 138*a*, 138*b*. However, it will be understood that the disclosure is not limited to this embodiment. For example, the snap connectors 122*a*, 122*b* may intersect with a different plane than the release openings 138*a*, 138*b*. Alternatively, the snap connector 122*a* and the release opening 138*a* may intersect with a first plane, and the snap connector 122*b* and the release opening 138*b* may intersect with a second plane.

FIG. 1 shows two bias member channels 118*a*, 118*a*, two bias members 120*a*, 120*b*, two snap connectors 122*a*, 122*b*, and two release openings 138*a*, 138*b*. However, it will be understood that the disclosure is not limited to two of these structures. For example, an exemplary embodiment may include a single one of each of the bias member channel 118*a*, the bias member 120*a*, the snap connector 122*a*, and the release opening 138*a*. Alternatively, an exemplary embodiment may include three or more of each of the bias member channels 118*a*, the bias members 120*a*, the snap connectors 122*a*, and the release openings 138*a*. These structures may be arranged symmetrically or asymmetrically around a circumference of the tool housing 102.

Figure 2:
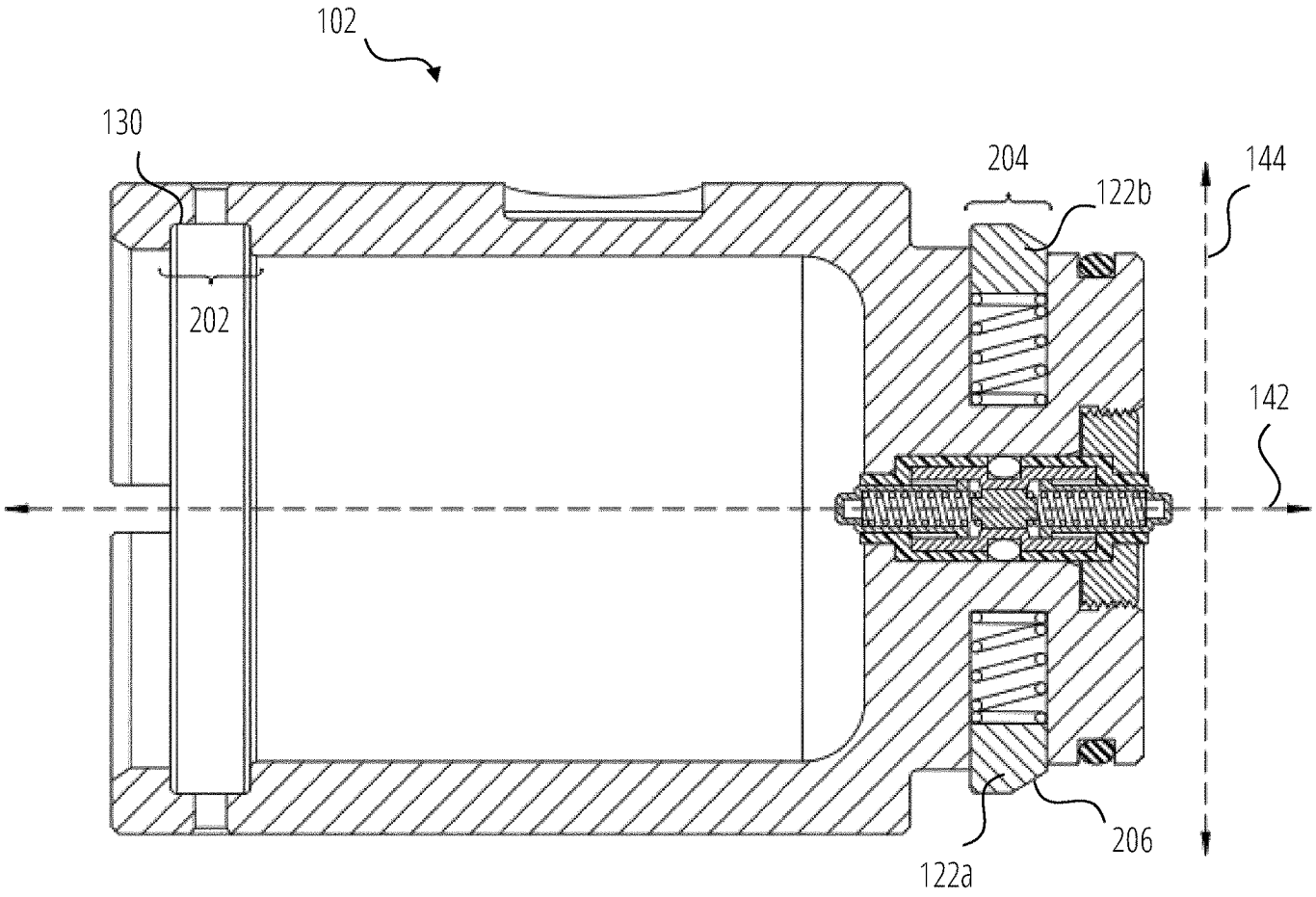
FIG. 2 is a cross-section view of a tool housing according to an exemplary embodiment.

FIG. 2 shows a further exemplary embodiment of the tool housing 102. As seen in FIG. 2, the connector groove 130 may have a groove width 202 in the axial direction 142, and the snap connector 122*a* may have a connector width 204 in the axial direction 142. It will be understood the snap connector 122*b* may have a similar width to the connector width 204 in the axial direction 142. In an exemplary embodiment, the groove width 202 may be greater than or equal to the connector width 204. FIG. 2 additionally shows that the snap connector 122*a* may include a chamfer contact surface 206. The chamfer contact surface 206 may be non-parallel with the radial direction 144. For example, as seen in FIG. 2, the chamfer contact surface 206 is sloped with respect to the radial direction 144.

Figure 3:
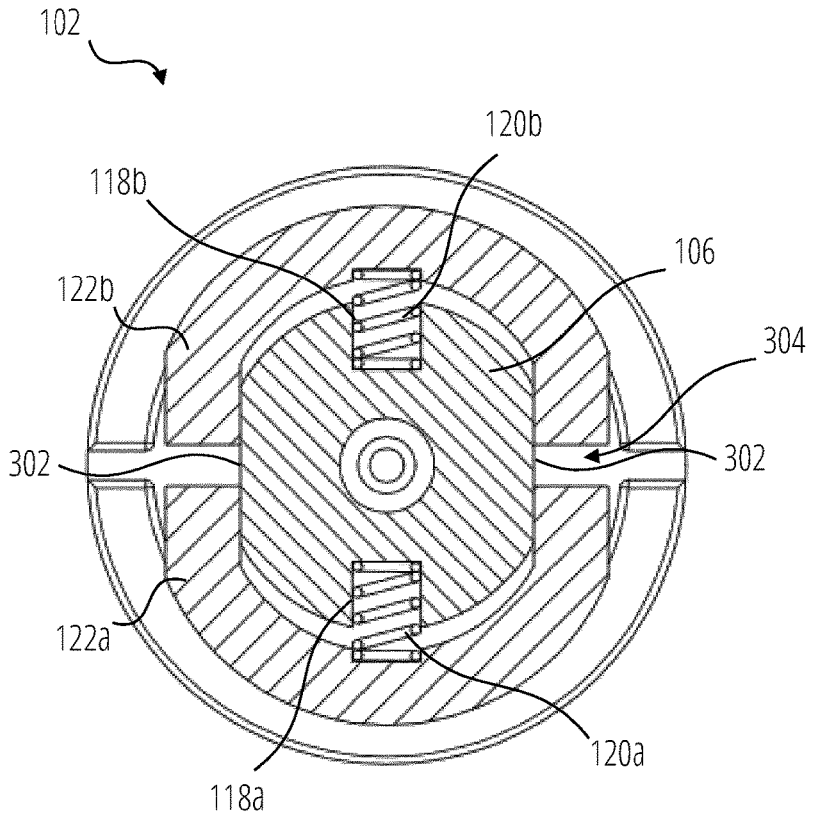
FIG. 3 is a transverse cross-section view of a tool housing according to an exemplary embodiment.

FIG. 3 shows a transverse cross-section of an exemplary embodiment of the tool housing 102. As seen in FIG. 3, the snap connectors 122*a*, 122*b* extend for nearly a half circle in the circumferential direction of the tool housing 102 around the first housing region 106. However, it will be understood that the disclosure is not limited to this embodiment and that the snap connectors 122*a*, 122*b* may have a shorter circumferential dimension. In the exemplary embodiment, a gap 304 may be formed between the snap connectors 122*a*, 122*b*. This may provide space for the snap connectors 122*a*, 122*b* to be retracted radially inwardly upon compression of the bias members 120*a*, 120*b*.

FIG. 3 further shows that the first housing region 106 may include chamfered sides 302 to facilitate radial movement of the snap connectors 122*a*, 122*b*.

Figure 4:
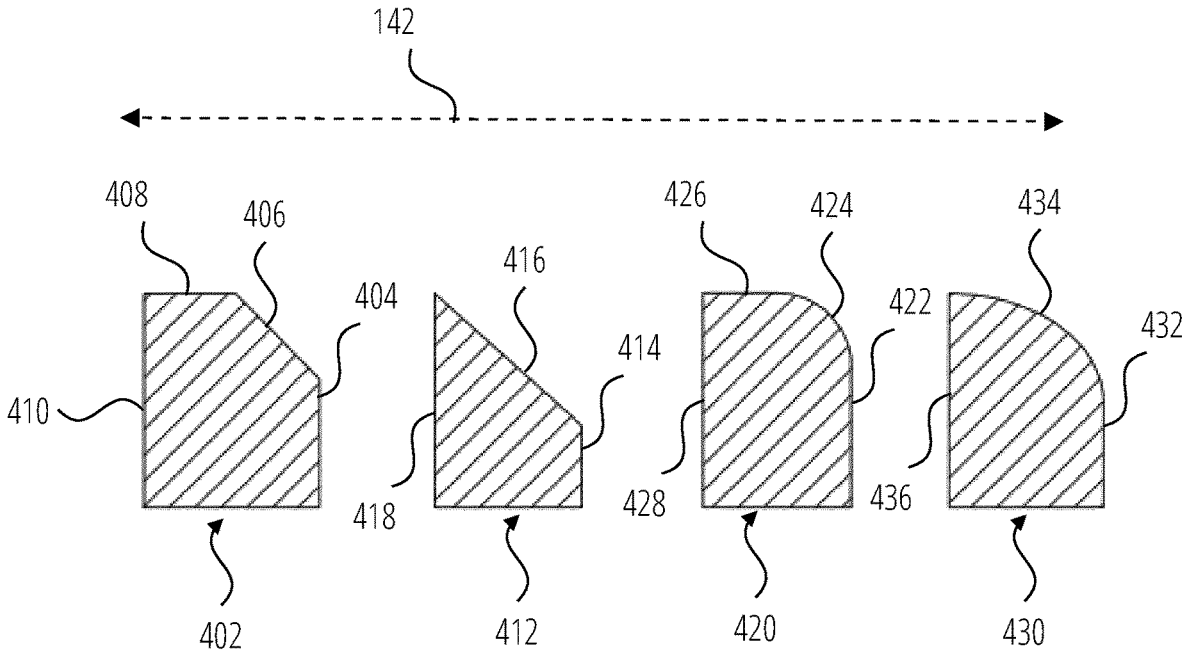
FIG. 4 shows side views of snap connectors according to exemplary embodiments.

FIG. 4 shows exemplary embodiments of surface profiles of snap connectors, with the axial direction 142 included for reference. For example, the snap connector 402 may have a front surface 404, a top surface 408, and a connector engagement surface 410. A flat chamfer contact surface 406 may extend between the front surface 404 and the top surface 408.

The snap connector 412 may include a front surface 414 and a connector engagement surface 418. A flat chamfer contact surface 416 may extend directly between the front surface 414 and the connector engagement surface 418. It will be noted that there is no separate top surface in the snap connector 412 due to the chamfer contact surface 416 extending directly from the front surface 414 to the connector engagement surface 418.

The snap connector 420 may include a front surface 422, a top surface 426, and a connector engagement surface 428. A curved or arcuate chamfer contact surface 424 may extend between the front surface 422 and the top surface 426.

The snap connector 430 may include a front surface 432 and a connector engagement surface 436. A curved or arcuate chamfer contact surface 434 may extend directly between front surface 432 and the connector engagement surface 436. It will be noted that there is no separate top surface in the snap connector 430 due to the chamfer contact surface 434 extending directly from the front surface 432 and the connector engagement surface 436.

The snap connectors may be formed of a variety of materials. For example, the snap connectors may be formed of a metal such as steel, titanium, or aluminum. Alternatively, the snap connectors may be formed of a plastic or ceramic material.

Figure 5:
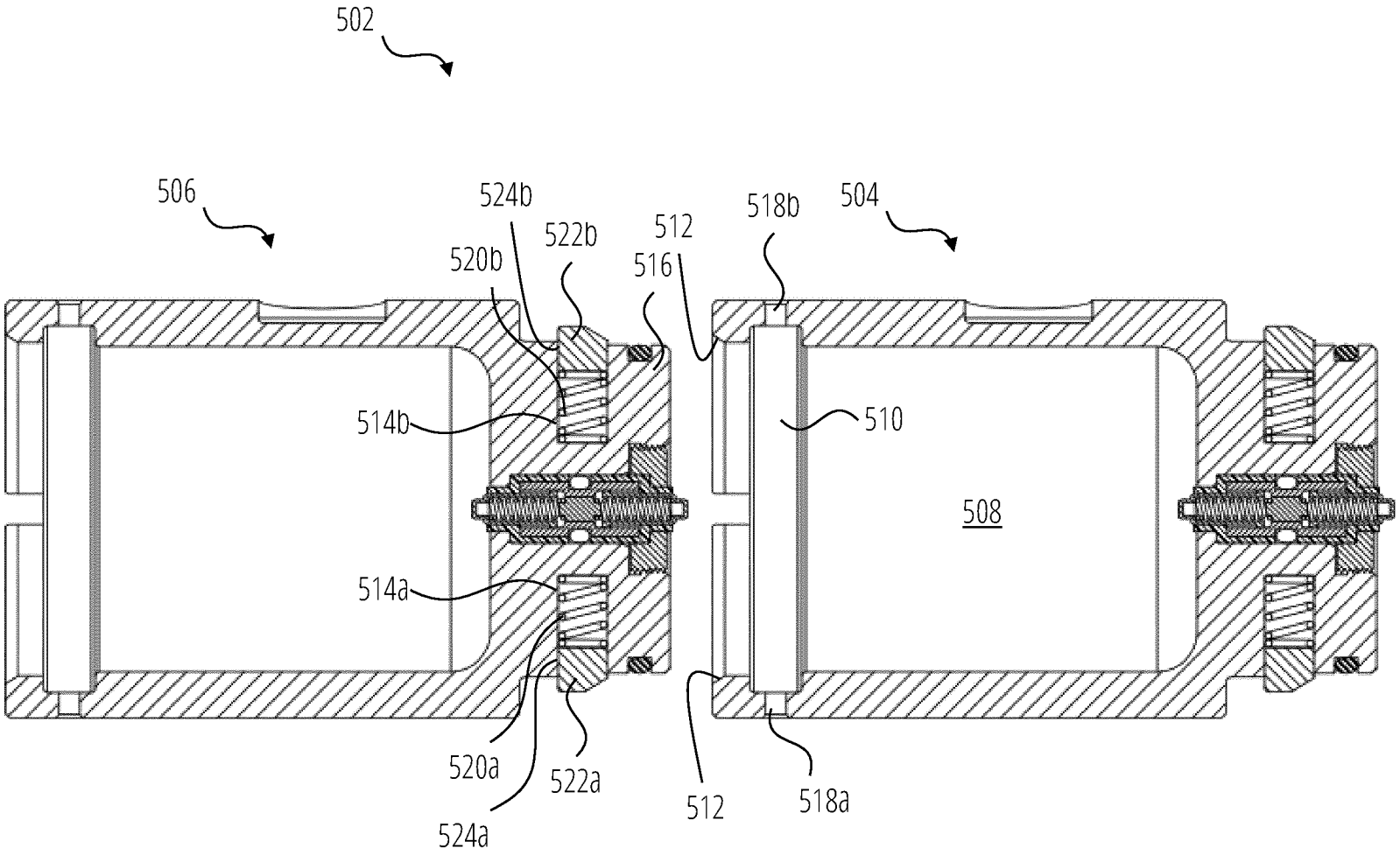
FIG. 5 is a cross-section view of a disassembled wellbore tool string according to an exemplary embodiment.

FIG. 5 shows an exemplary embodiment of a disassembled wellbore tool string 502. The wellbore tool string 502 may include a first tool housing 504 and a second tool housing 506. Each of the first tool housing 504 and the second tool housing 506 may be similar in structure to the tool housing 102 described with reference to FIG. 1 and FIG. 2.

Figure 6:
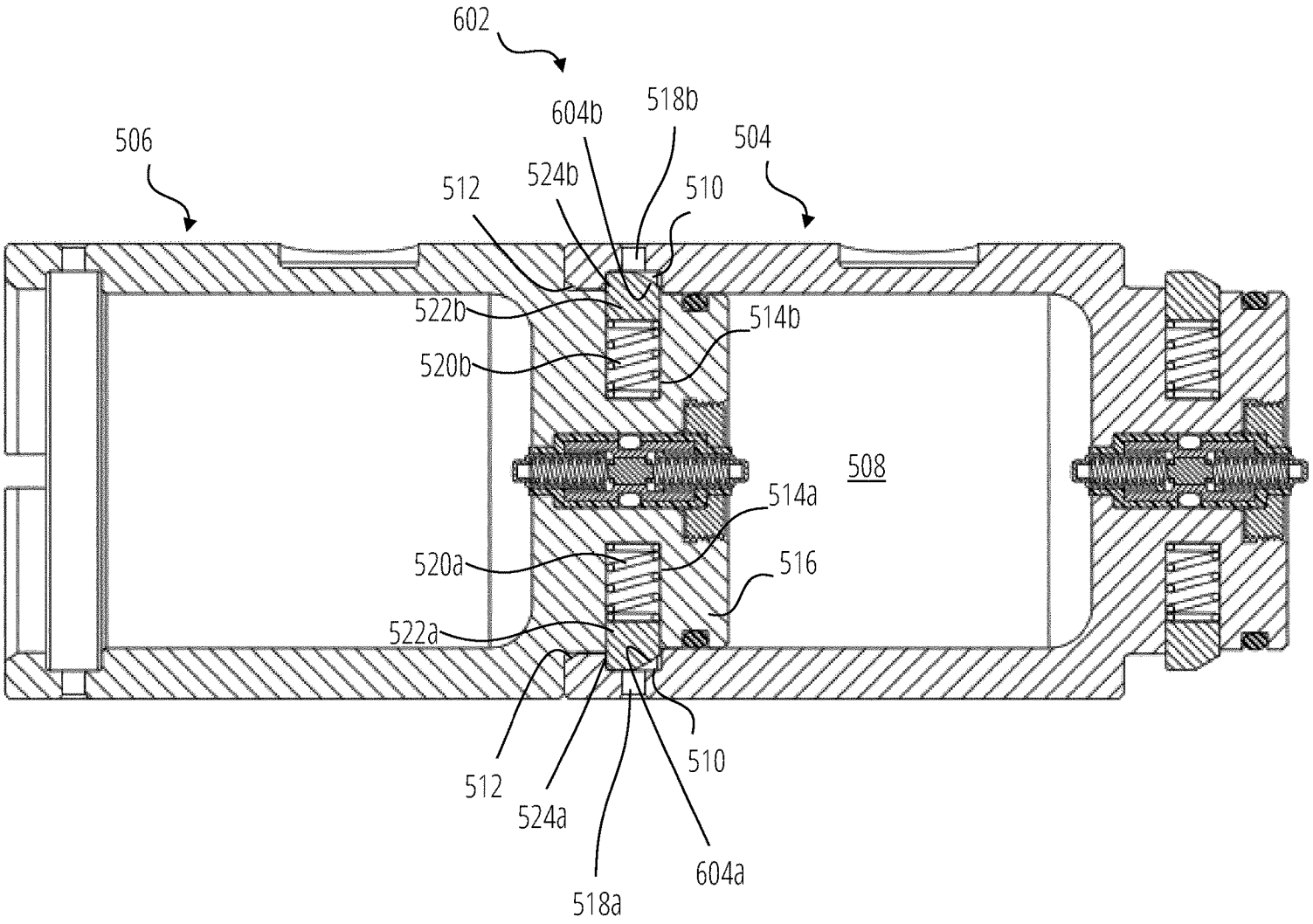
FIG. 6 is a cross-section view of a wellbore tool string according to an exemplary embodiment.

FIG. 6 shows a cross-section of an assembled wellbore tool string 602. The wellbore tool string 602 may include a first tool housing 504 and a second tool housing 506. Each of the first tool housing 504 and the second tool housing 506 may be similar in structure to the tool housing 102 as described above with reference to FIG. 1 through FIG. 2.

In an exemplary embodiment, the first tool housing 504 and the second tool housing 506 may be coupled together. For example, the first housing region 516 of the second tool housing 506 may be positioned proximate to the open end of the first tool housing 504.

The first housing region 516 of the second tool housing 506 may then be inserted into the hollow interior 508 of the first tool housing 504 until the chamfer contact surface 604*a* of the snap connector 522*a* and the chamfer contact surface 604*b* of the snap connector 522*b* abut with the inlet chamfer 512 of the first tool housing 504. As the first housing region 516 of the second tool housing 506 is further inserted into the hollow interior 508 of the first tool housing 504, the inlet chamfer 512 presses against the chamfer contact surface 604*a* and the chamfer contact surface 604*b*, which in turn pushes the snap connectors 522*a*, 522*b* into bias member channels 514*a*, 514*b*.

As the first housing region 516 of the second tool housing 506 is inserted further into the hollow interior 508 of the first tool housing 504, the snap connectors 522*a*, 522*b* reach the connector groove 510 of the first tool housing 504. At this point, the biasing force of bias members 520*a*, 520*b* pushes the snap connectors 522*a*, 522*b* into the connector groove 510.

Once the snap connectors 522*a*, 522*b* extend into the connector groove 510 of the first tool housing 504, the first tool housing 504 and the second tool housing 506 are securely coupled together. If the second tool housing 506 is pulled away from the first tool housing 504, then the connector engagement surfaces 524*a*, 524*b* abut a side wall of the connector groove 510. Thus, removal of the second tool housing 506 is prevented, and the first tool housing 504 and the second tool housing 506 remain securely coupled together.

If a user wishes to remove the second tool housing 506 from the first tool housing 504, a tool can be inserted through release openings 518*a*, 518*b* to push the snap connectors 522*a*, 522*b* back into or toward the bias member channels 514*a*, 514*b*, thereby releasing the second tool housing 506 from the first tool housing 504. Additionally, a user may be able to look through the release openings 518*a*, 518*b* to visually confirm that the snap connectors 522*a*, snap connectors 522*b* are securely seated within the connector groove 510.

Figure 7:
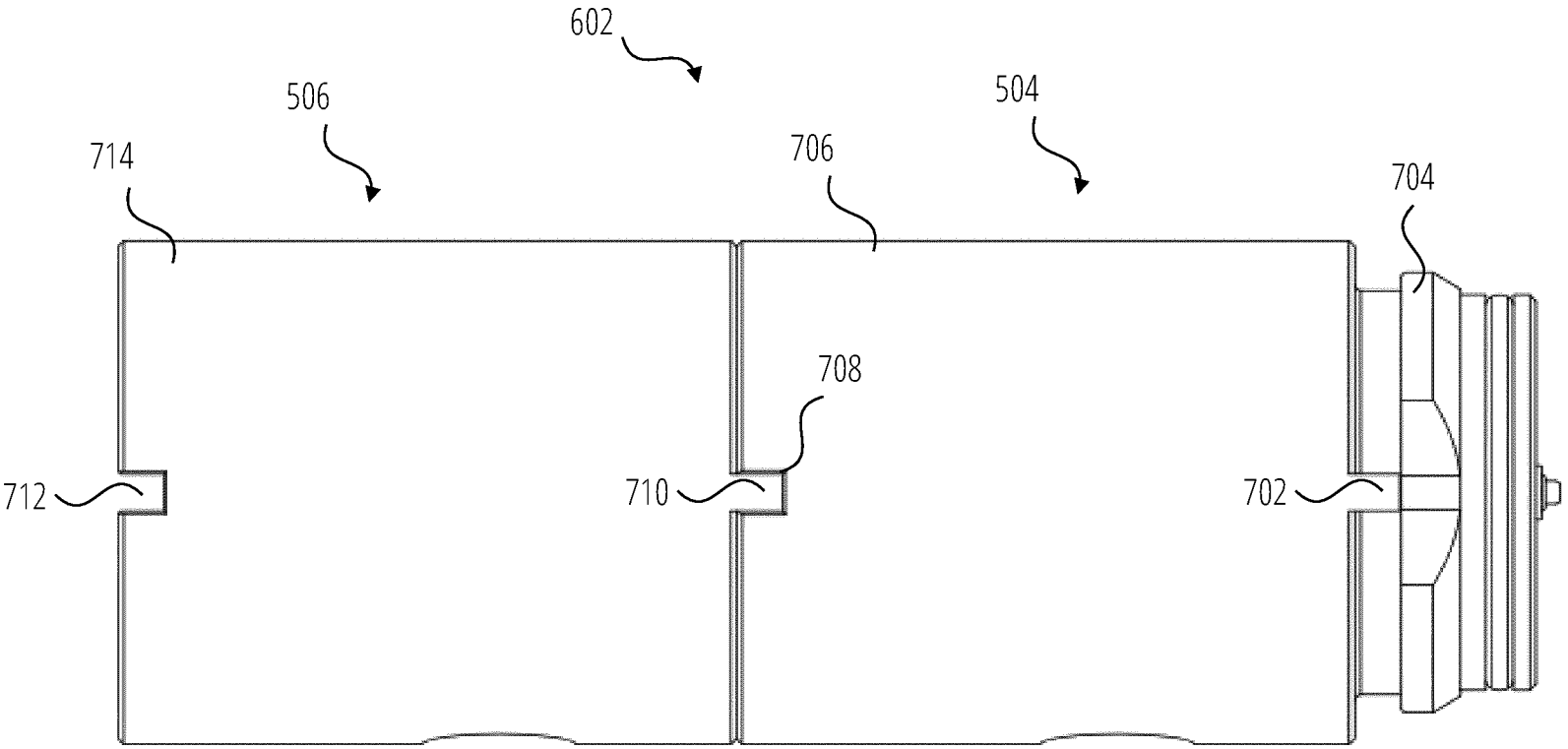
FIG. 7 shows a side view of a wellbore tool string according to an exemplary embodiment.

FIG. 7 shows an exterior side view of an exemplary embodiment of the wellbore tool string 602. As seen in FIG. 7, the first tool housing 504 may include a first key rib 702 extending radially outward from a first housing region 704 of the first tool housing 504. The first tool housing 504 may further include a first key groove 708 formed in an end of the second housing region 706 of the first tool housing 504.

Similarly, the second tool housing 506 may include a second key rib 710 extending radially outward from the first housing region 516 of the second tool housing 506 and a second key groove 712 formed in an end of a second housing region 714 of the second tool housing 506. It will be understood that the first housing region 516 of the second tool housing 506 is not visible in FIG. 7, as it has been inserted into the second housing region 706 of the first tool housing 504. As seen in FIG. 7, the second key rib 710 of the second tool housing 506 fits into the first key groove 708 of the first tool housing 504. In this way, proper relative alignment (i.e., about a common central axis of the first tool housing 504 and the second tool housing 506) of the first tool housing 504 and the second tool housing 506 may be ensured, so that the snap connectors 522*a*, snap connector 522*b* of the second tool housing 506 properly align with the connector groove 510 and/or release openings 518*a*, 518*b* of the first tool housing 504.

Figures 8A, 8B, 8C:
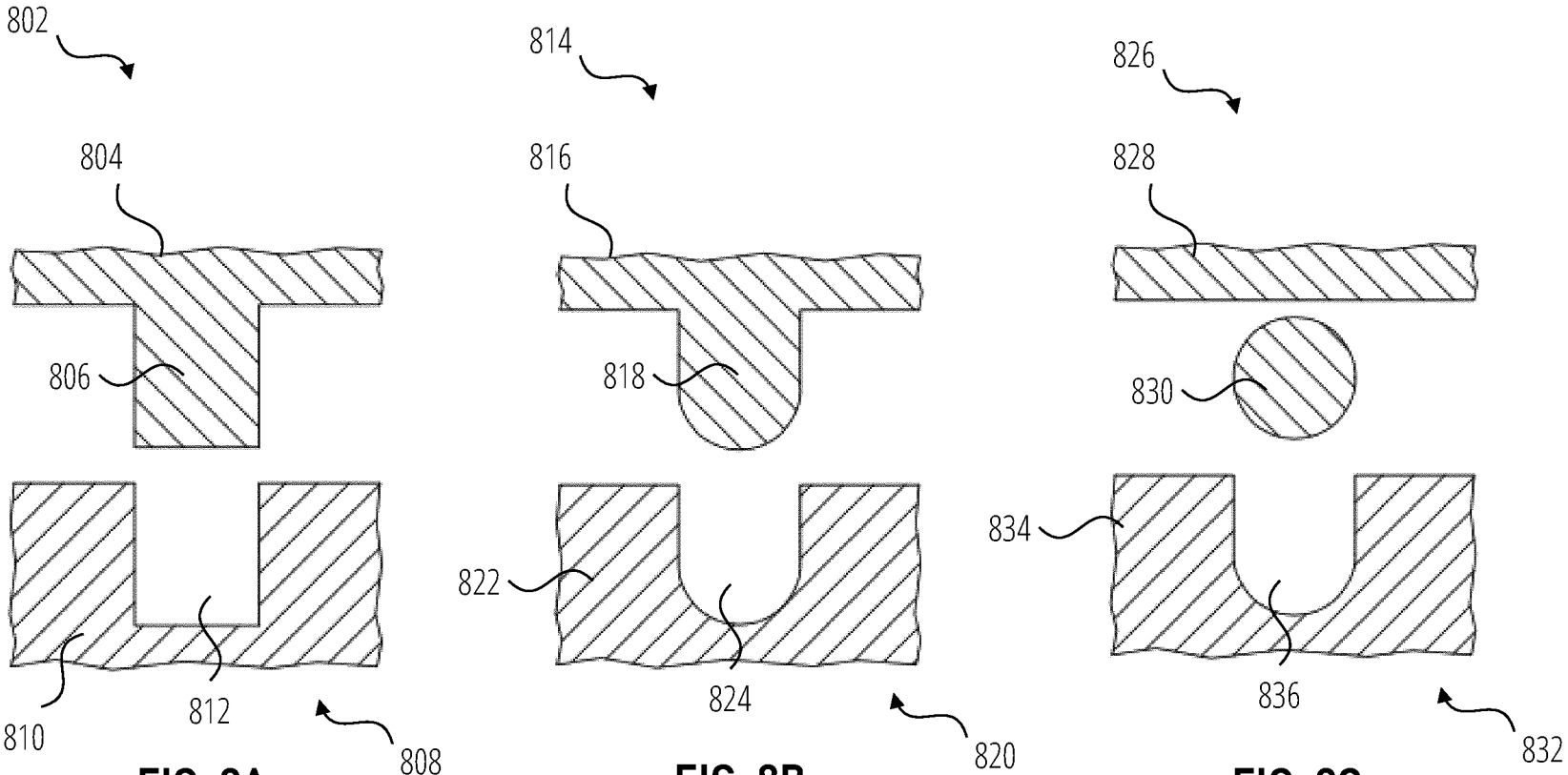
FIG. 8A is a top view of a key rib and key groove according to an exemplary embodiment.
FIG. 8B is a top view of a key rib and key groove according to an exemplary embodiment.
FIG. 8C is a top view of a key rib and key groove according to an exemplary embodiment.

FIG. 8A, FIG. 8B, and FIG. 8C show exemplary embodiments of key ribs and key grooves. In each of FIG. 8A, FIG. 8B, and FIG. 8C, the view is looking down at the key rib in the radial direction. FIG. 8A shows a first tool housing 802 having a second housing region 804 and a second tool housing 808 having a second housing region 810. The first tool housing 802 includes a key rib 806 extending radially outward from a first housing region (not seen in FIG. 8A). As further seen in FIG. 8A, the key rib 806 may have a rectilinear shape. The second tool housing 808 has a second housing region 810 with a key groove 812 formed in the end. The key groove 812 may be rectilinear in shape and sized to couple with the key rib 806 of the first tool housing 802.

FIG. 8B shows a first tool housing 814 having a second housing region 816 and a second tool housing 820 having a second housing region 822. The first tool housing 814 includes a key rib 818 extending radially outward from a first housing region (not seen in FIG. 8B). As further seen in FIG. 8B, the key rib 818 has a curved shape. The second housing region 822 has a key groove 824 formed in the end. The key groove 824 may have a rounded shaped and be sized to couple with the key rib 818 of the first tool housing 814.

FIG. 8C shows a first tool housing 826 having a second housing region 828 and a second tool housing 832 having a second housing region 834. The first tool housing 826 includes a key rib 830 extending radially outward from a first housing region (not seen in FIG. 8C). It will be noted that the key rib 830 is not connected to the second housing region 828 in this exemplary embodiment, in contrast with the key rib 806 of FIG. 8A and the key rib 818 of FIG. 8B. In an exemplary embodiment, the key rib 830 may take the form of a post, pin, screw, or the like that is coupled to or provided on an outer surface of the first housing region of the first tool housing 826. The key rib 830 may have a round shape. The second housing region 834 may have a key groove 836 formed in the end. The key groove 836 may have a round shape and be sized to couple with the key rib 830.

Figure 9:
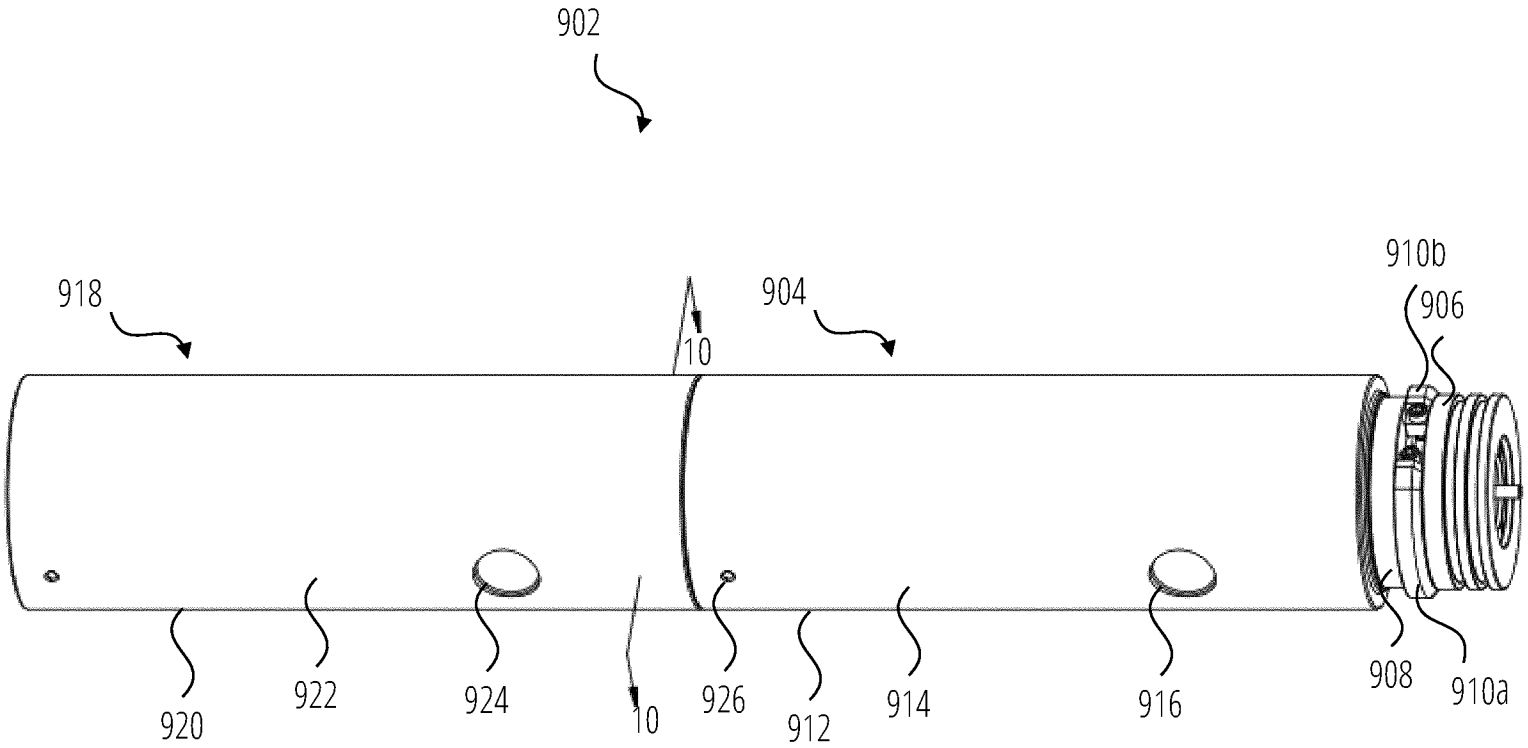
FIG. 9 is a perspective view of a wellbore tool string according to an exemplary embodiment.

FIG. 9 shows an exterior perspective view of an exemplary embodiment of a wellbore tool string 902 in an assembled configuration. Similar to the wellbore tool string 602 described with reference to FIG. 5 and FIG. 6, the wellbore tool string 902 shown in FIG. 9 may include a first tool housing 904 and a second tool housing 918. The first tool housing 904 may be a housing body extending in an axial direction and may include a first housing region 906 having a first outer surface 908, and a second housing region 912 having a second outer surface 914 into which a scallop 916 may be formed. Snap connectors 910*a*, 910*b* may be engaged with the first housing region 906 of the first tool housing 904 as part of a connection assembly for connection to an adjacent wellbore tool. A release opening 926 may be provided on the second housing region 912, as detailed in FIG. 10 with respect to release openings 1020*a*, 1020*b*.

The second tool housing 918 may include a first housing region and a second housing region 920. In an exemplary embodiment, the first tool housing 904 and the second tool housing 918 may be coupled together. It will be understood that the first housing region of the second tool housing 918 is not visible in FIG. 9, as it has been inserted into the second housing region 912 of the first tool housing 904. A scallop 924 may be formed on a second outer surface 922 of the second tool housing 918.

Figure 10:
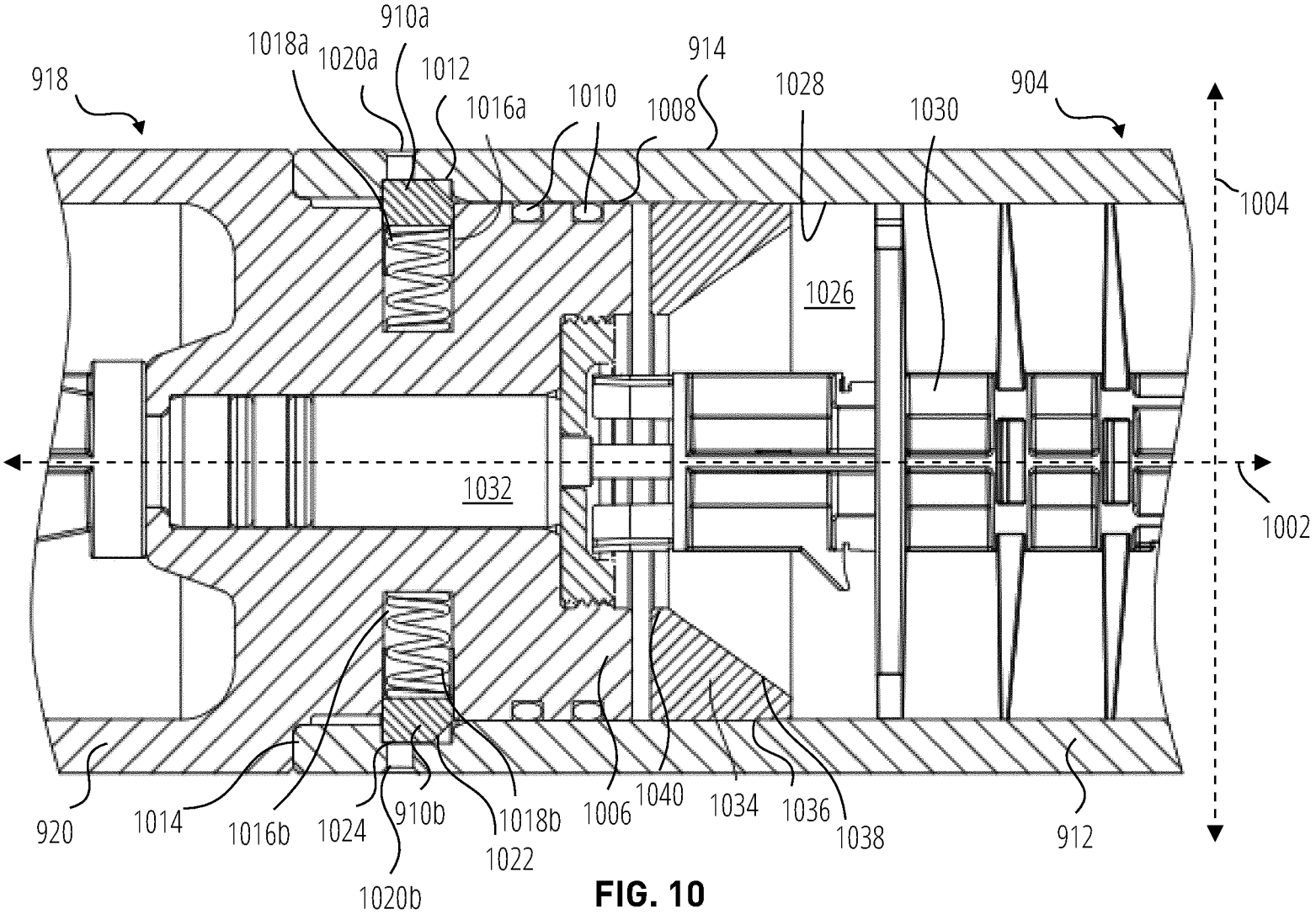
FIG. 10 is a partial cross-section view of the wellbore tool string of FIG. 9.

FIG. 10 is a partial cross-section view of the wellbore tool string 902 of FIG. 9, showing in detail the coupling between the first tool housing 904 and the second tool housing 918.

The second housing region 912 of the first tool housing 904 may include a hollow interior 1026 provided within the second housing region 912. The hollow interior 1026 may be bound at least in part by a hollow interior surface 1028 in the radial direction 1004. The hollow interior 1026 may open to an exterior space at an open end 1014.

The second housing region 912 may further include a snap connector groove 1012 extending outwardly from the hollow interior surface 1028 in the radial direction 1004. The snap connector groove 1012 may extend around a full circumference of the hollow interior surface 1028. However, the disclosure is not limited to this embodiment. For example, the snap connector groove 1012 may be configured as a plurality of discrete grooves spaced around the circumference of the hollow interior surface 1028 of the hollow interior 1026 and corresponding to angular positions of the snap connector 910*a*, 910*b*.

The second housing region 912 may further include release openings 1020*a*, 1020*b*. The release opening 1020*a*, 1020*b* may each extend from the second outer surface 914 of the second housing region 912 to the snap connector groove 1012. In an exemplary embodiment, a total number of the release opening 1020*a*, 1020*b* may be equal to a total number of the snap connector 910*a*, 910*b* such that the release openings are in a one-to-one correspondence with the snap connectors.

The second tool housing 918 may include a first housing region 1006 defined by a first outer surface 1008. One or more seal elements 1010, such as o-rings, may be provided on the first outer surface 1008 of the first housing region 1006. Bias member channels 1016*a*, 1016*b* may be provided in the first housing region 1006. The bias member channel 1016*a*, 1016*b* may extend inward in a radial direction 1004 from the first outer surface 1008 of the first housing region 1006.

Bias members 1018*a*, 1018*b* may be provided within the bias member channel 1016*a*, 1016*b*. The bias member 1018*a*, 1018*b* may be a spring member such as a coil spring, leaf spring, or other suitable structure. Snap connectors 910*a*, 910*b* may be engaged with the bias member 1018*a*, 1018*b* such that the bias members 1018*a*, 1018*b* bias the snap connectors 910*a*, 910*b* outward in the radial direction 1004.

In an exemplary embodiment, the first tool housing 904 and the second tool housing 918 may be coupled together as described above with reference to FIG. 6. In an exemplary embodiment, the release openings 1020*a*, 1020*b* and the snap connectors 910*a*, 910*b* may intersect with a common plane that includes a central axis of the tool housing 102 (the central axis may be represented by the broken line indicating the axial direction 1002). However, it will be understood that the disclosure is not limited to this embodiment. For example, the snap connectors 910*a*, 910*b* may intersect with a different plane than the release openings 1020*a*, 1020*b*. Alternatively, the snap connector 910*a* and the release opening 1020*a* may intersect with a first plane, and the snap connector 910*b* and the release opening 1020*b* may intersect with a second plane.

Once the snap connectors 910*a*, 910*b* extend into the snap connector groove 1014 of the first tool housing 904, the first tool housing 904 and the second tool housing 918 are securely coupled together. If the second tool housing 918 is pulled away from the first tool housing 904, then connector engagement surfaces (see, e.g., connector engagement surfaces 524*a*, 524*b* of FIG. 5) abut a side wall of the snap connector groove 1014. Thus, removal of the second tool housing 918 is prevented, and the first tool housing 904 and the second tool housing 918 remain securely coupled together.

FIG. 10 shows that the snap connector 910*b* may include a chamfer contact surface 1022. The chamfer contact surface 1022 may be non-parallel with the radial direction 1004. For example, as seen in FIG. 10, the chamfer contact surface 1022 is sloped with respect to the radial direction 1004. The snap connector 910*b* may further include a top surface 1024 connected to the chamfer contact surface 1022 and extending in an axial direction 1002. As shown in FIG. 10, the top surface 1024 may extend along an axial length that radially overlaps the release opening 1020*a*, such that when the snap connector 910*a* is locked into the snap connector groove 1014, the top surface 1024 seals the release opening 1020*a*, thereby preventing entry of wellbore sediment or debris through the release opening 1020*a*.

A detonator holder 1030 may be positioned within the hollow interior 1026 of the second housing region 912 of the first tool housing 904. The detonator holder 1030 may contain a wireless detonator that may be in electrical communication with a bulkhead 1032 that is provided in the first housing region 1006 of the second tool housing 918.

A blast absorber 1034 may also be provided in the hollow interior 1026 of the second housing region 912 between the detonator holder 1030 and the first housing region 1006 of the second tool housing 918. The blast absorber may be machined, 3-D printed or injected molded, and be made of a high-temperature plastic material. The blast absorber 1034 may include a blast absorber outer wall 1036 that is secured in place against the hollow interior surface 1028 of the hollow interior 1026, for example, by frictional engagement. In an aspect, the blast absorber 1034 may include a seal element, for example an o-ring, provided around the blast absorber outer wall 1036 to secure the position of the blast absorber 1034 within the hollow interior 1026. The blast absorber in an exemplary embodiment may include a retention element, such as a snap ring or safety clip, to retain the blast absorber in its position. The blast absorber 1034 may further include a blast absorber inner wall 1038 that defines an opening 1040 of the blast absorber 1034 through which the electrical connection between the detonator and the bulkhead 1032 may be made. In an exemplary embodiment, the blast absorber inner wall 1038 may be sloped and extend axially from the opening 1040.

In use, when a ballistic force (e.g., from a detonator, shaped charge, or another component) is generated inside the hollow interior 1026, debris from the ballistic force, including the detonator holder 1030, may migrate to the open end 1014 of the first tool housing 904 and into the connector groove and/or bias member channels in which the snap connector 910*a*, 910*b* and bias member 520*a*, 520*b* are positioned. Debris, dirt, grime, soot, and the like may interfere with the functionality of the movable connection mechanisms (i.e., snap connectors 910*a*, 910*b* and bias member 520*a*, 520*b*). The blast absorber 1034 may therefore shield the second tool housing 918 and associated connection mechanisms from the ballistic force generated inside the hollow interior 1026, and prevent movement of debris from within the hollow interior 1026 toward the second tool housing 918.

Figure 11:
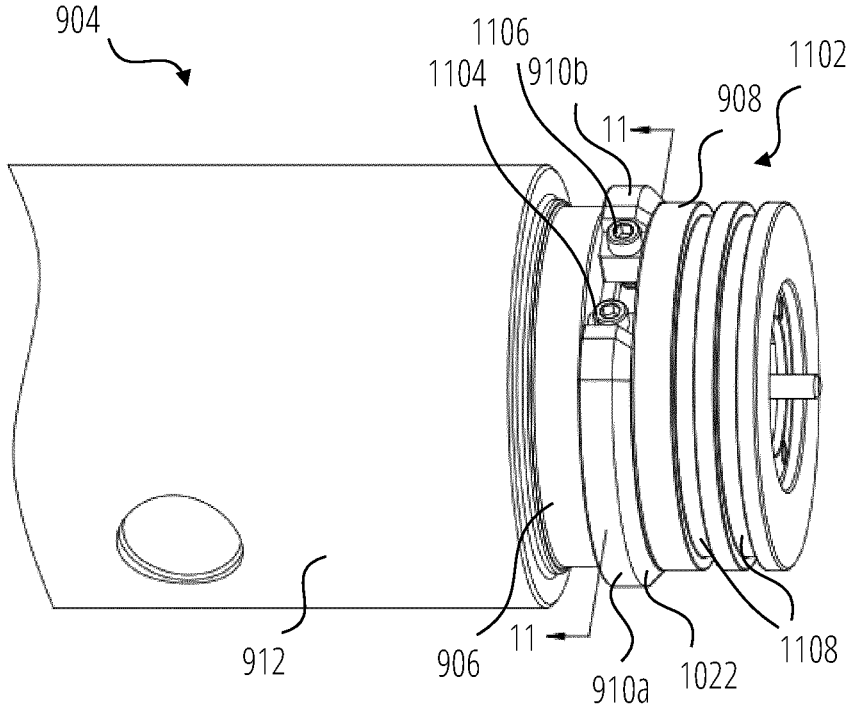
FIG. 11 show a partial perspective view of a wellbore tool connection assembly according to an exemplary embodiment.
Figure 12:
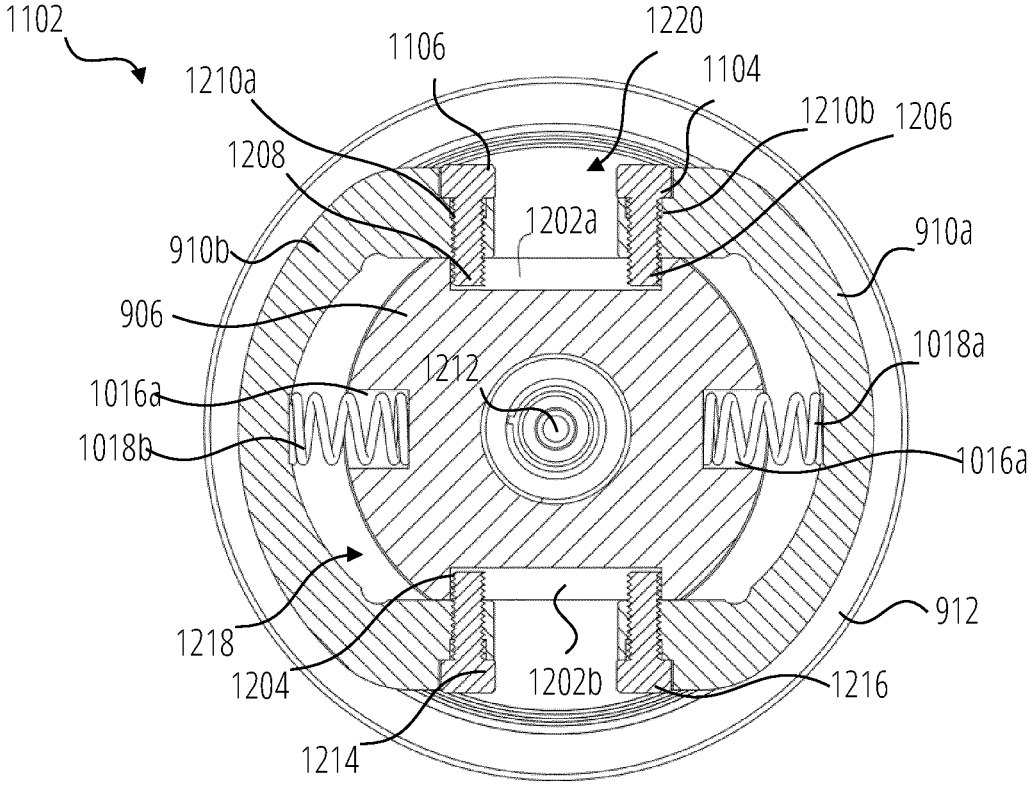
FIG. 12 is a transverse cross-section view of the wellbore tool connection assembly of FIG. 11.
Figure 13:
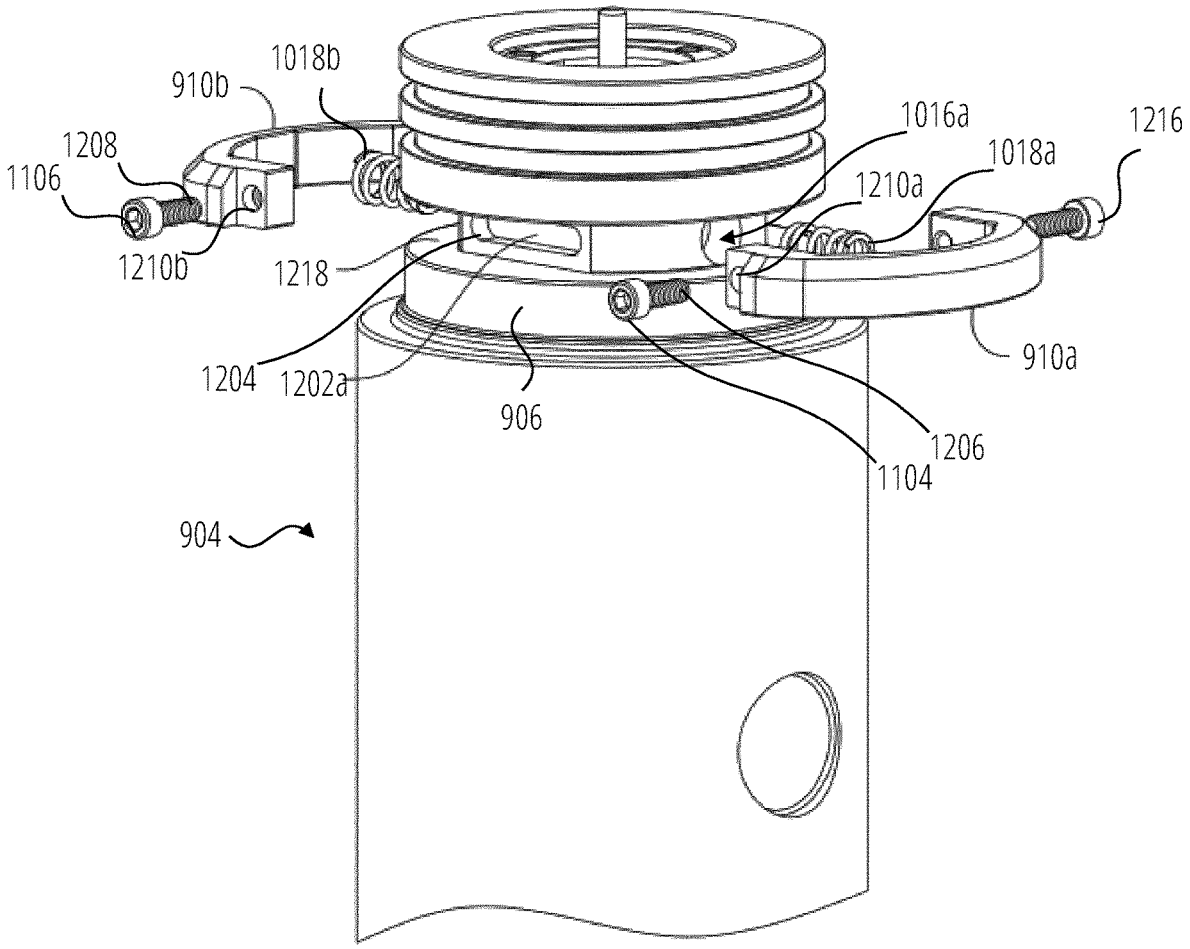
FIG. 13 is an exploded partial perspective view of the wellbore tool connection assembly of FIG. 11.

FIG. 11, FIG. 12, and FIG. 13 show details of a wellbore tool connection assembly 1102 provided in connection with the first tool housing 904 of FIG. 9. FIG. 11 is a partial perspective view of the first tool housing 904, in which the wellbore tool connection assembly 1102 is shown in greater detail. The wellbore tool connection assembly 1102 may be provided on the first housing region 906 and may include the first snap connector 910*a* and the second snap connector 910*b*. Each snap connector 910*a*, 910*b* may have a respective retainer screw 1104 engaged therewith, for example, in an end portion of each respective snap connector 910*a*, 910*b*, that may be configured for retaining the snap connector 910*a*, 910*b* in its respective position relative to the first housing region 906 and preventing the snap connectors 910*a*, 910*b* from separating from the first tool housing 904 before connection to an adjacent wellbore tool. Each of the snap connectors 910*a*, 910*b* may have a chamfer contact surface 1022 to reduce the force required to assemble the wellbore tool string 902, as discussed above with reference to FIG. 6 and FIG. 10. One or more seal element channels 1108 may be provided on the first outer surface 908 of the first housing region 906 to receive and retain a seal element.

FIG. 12 shows a transverse cross-section view of the wellbore tool connection assembly 1102 of FIG. 11. Bias member channels 1016*a*, 1016*b* may be provided in the first housing region 906. The bias member channel 1016*a*, 1016*b* may extend inward in a radial direction (i.e., towards a center 1212 of the first tool housing 904) from the first outer surface 908 of the first housing region 906. Bias members 1018*a*, 1018*b* may be provided within the bias member channels 1016*a*, 1016*b*.

The retainer screws 1104, 1106 may be inserted through retainer screw holes 1210*a*, 1210*b* formed in the end portion of each of the snap connectors 910*a*, 910*b* and extend inward in a radial direction toward the center 1212 of the first tool housing 904 into a recess 1202*a* formed in the first housing region 906. In an aspect, a second recess 1202*a* may be provided in the first housing region 906, which may be circumferentially spaced apart from the recess 1202*a*. The recess 1202*a*, 1202*b* may extend inward in the radial direction from the first outer surface 908 of the first housing region 906 and may be bound by a recess wall 1204 (labeled with respect to recess 1202*a*). Retainer screw ends 1206, 1208 may be retained in the recess 1202*a* such that each retainer screw 1104, 1106 is biased against the recess wall 1204. In an aspect, the second recess 1202*a* may be provided circumferentially opposite to the first recess 1202*a*. Each snap connector 910*a*, 910*b* may be engaged with a second retainer screw 1214, 1216 such that one retainer screw is engaged with each end portion of the snap connector. The second retainer screw 1214, 1216 of each snap connector may be provided in the second recess 1202*a*.

A gap 1220 may be provided between the ends of snap connectors 910*a*, 910*b* radially adjacent to the recess 1202*a*, 1202*b*. When the wellbore tool connection assembly 1102 is used for connection to an adjacent wellbore tool housing, as described above with reference to FIG. 6, the bias members 1018*a*, 1018*b* are compressed inward to allow passage of the snap connector 910*a*, 910*b* through the hollow interior of the adjacent wellbore tool, then subsequently bias the snap connector 910*a*, 910*b* outward to lock to the adjacent wellbore tool. The gap 1220 between the snap connectors 910*a*, 910*b* may enable radial movement of the snap connectors 910*a*, 910*b* and corresponding movement of the retainer screws 1104, 1106 during the coupling of the wellbore tools and formation of the wellbore tool string 902.

FIG. 12 shows two bias member channels 1016*a*, 1016*b*, two bias members 1018*a*, 1018*b*, and two snap connectors 910*a*, 910*b*. However, it will be understood that the disclosure is not limited to two of these structures. For example, an exemplary embodiment may include a single one of each of the bias member channel 1016*a*, the bias member 1018*a*, and the snap connector 910*a*. Alternatively, an exemplary embodiment may include three or more of each of the bias member channel 1016*a*, 1016*b*, the bias members 1018*a*, 1018*b*, and the snap connectors 910*a*, 910*b*. These structures may be arranged symmetrically or asymmetrically around a circumference of the first tool housing 904.

FIG. 13 is a partial exploded view of the wellbore tool connection assembly 1102 showing components of the assembly in detail. As shown in FIG. 12 and FIG. 13, a snap connector channel 1218 may be formed in the first housing region 906 to receive the snap connectors 910*a*, 910*b* and bias members 1018*a*, 1018*b*. The snap connector channel 1218 may define an axial length of the first housing region 906 into which the bias member channels 1016*a*, 1016*b*, and the recesses 1202*a*, 1202*b* are formed.

Figure 14A:
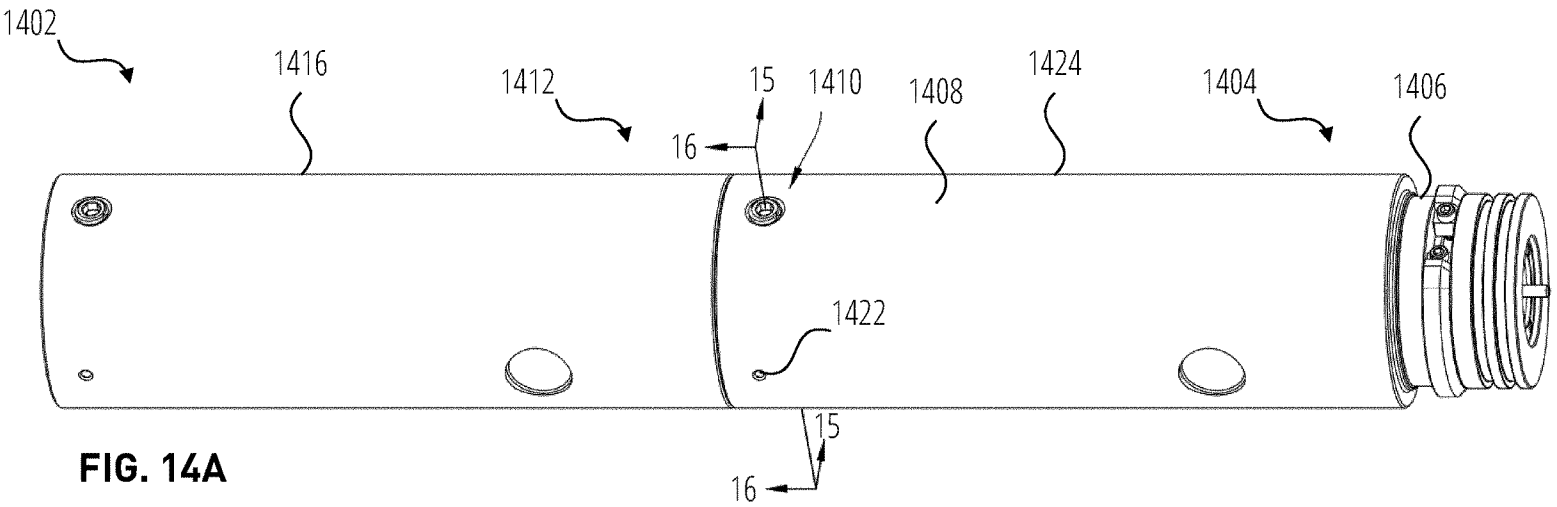
FIG. 14A shows a perspective view of a wellbore tool string according to an exemplary embodiment.

FIG. 14A shows an exterior perspective view of an exemplary embodiment of a wellbore tool string 1402 in an assembled configuration. The wellbore tool string 1402 includes a first tool housing 1404 and a second tool housing 1412. Each of the first tool housing 1404 and the second tool housing 1412 may be similar in structure to the tool housing 102 as described above with reference to FIG. 1 through FIG. 2, and coupled together as described above with reference to FIG. 6 and FIG. 10. The first tool housing 1404 may include a first housing region 1406 and a second housing region 1408. An external screw 1410 may be positioned in an external screw hole formed in the second housing region 1408 of the first tool housing 1404. When coupled together (as described above with reference to FIG. 10), the first housing region 1414 of the second tool housing 1412 is inserted into the second housing region 1408 of the first tool housing 1404. The external screw 1410 may be provided to further secure the coupling of the first tool housing 1404 to the second tool housing 1412. A release opening 1422 may be provided on the second housing region 1408.

Figure 14B:
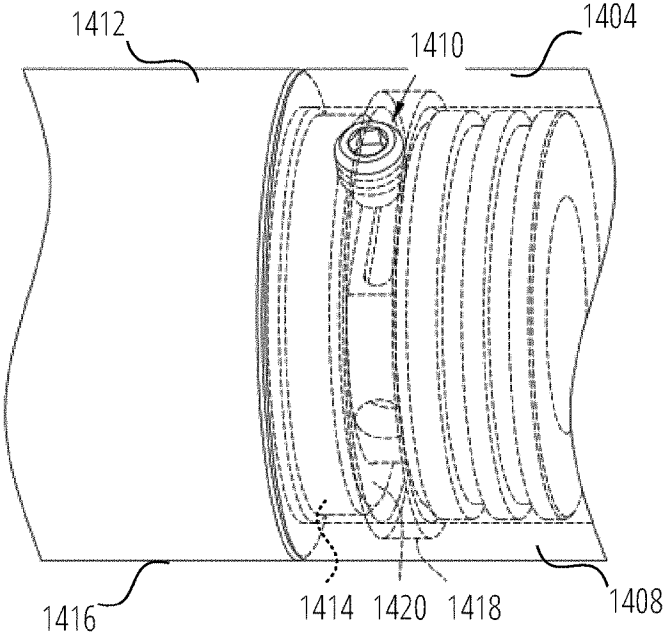
FIG. 14B is a partial cutaway view of the wellbore tool string of FIG. 14A.

FIG. 14B shows a partial cutaway view of the coupling of the first tool housing 1404 with the second tool housing 1412. The second tool housing 1412 may include a first housing region 1414 and a second housing region 1416. A snap connector groove 1418 may be provided on the second housing region 1408 of the first tool housing 1404 as described with reference to FIG. 10. The external screw 1410 may be inserted through the wall of the second housing region 1408 and into the snap connector groove 1418. The external screw 1410 may further extend radially inward into a snap connector channel 1420 formed in the first housing region 1414 of the second tool housing 1412.

Figure 15A:
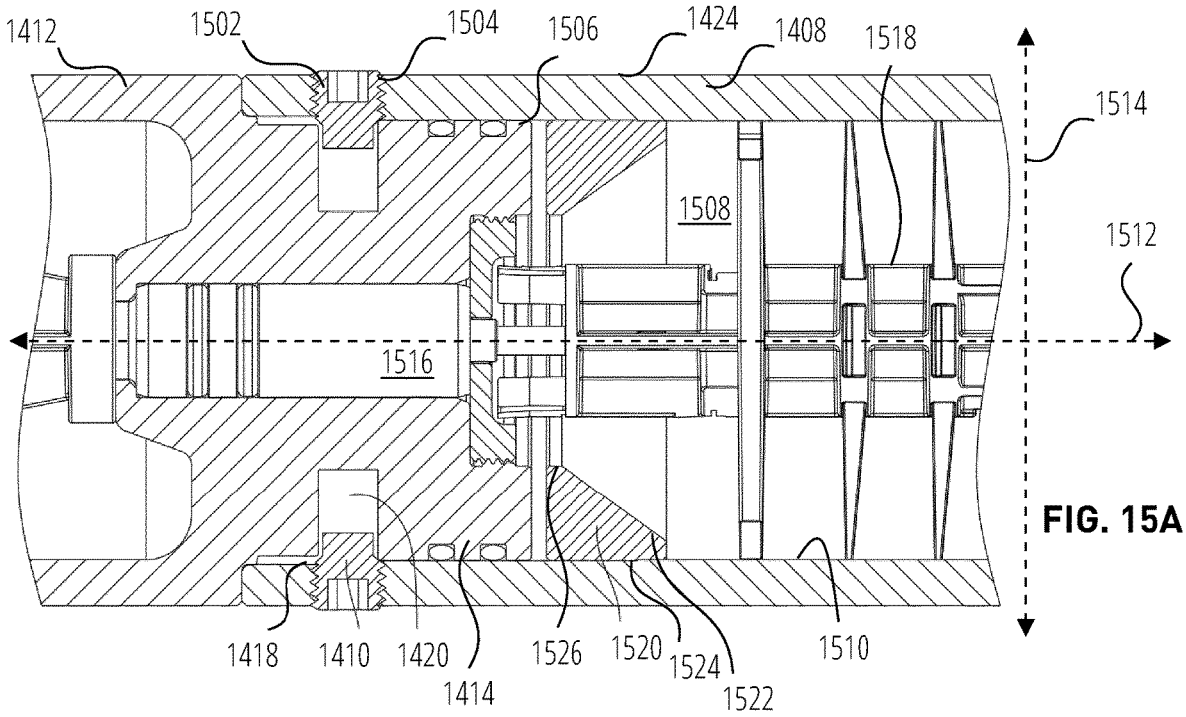
FIG. 15A is a partial cross-section view of the wellbore tool string of FIG. 14A.

FIG. 15A shows a partial cross section view of the wellbore tool string 1402 of FIG. 14A. The second housing region 1408 of the first tool housing 1404 may include a hollow interior 1508 provided within the second housing region 1408. The hollow interior 1508 may be bound at least in part by a hollow interior surface 1510 in the radial direction 1514.

The snap connector groove 1418 may extend outwardly from the hollow interior surface 1510 in a radial direction 1514. An external screw hole 1504 may extend from the second outer surface 1424 to the snap connector groove 1418 for receiving the external screw 1410. Positioning of the external screw 1410 radially inward into the connector groove 1418 and/or the snap connector channel 1420 may prevent movement in an axial direction 1512 of the second tool housing 1412 relative to the first tool housing 1404.

The first housing region 1414 of the second tool housing 1412 may be defined by a first outer surface 1506. The snap connector channel 1420 may be formed in the first housing region 1414, and the external screw 1410, 1504 may extend into the snap connector channel 1420 such that the external screw 1410, 1504 secures the coupling of the first tool housing 1404 to the second tool housing 1412. In an exemplary embodiment, the external screw hole 1504, external screws 1410, 1502, snap connector groove 1418, and snap connector channel 1420 may intersect with a common plane that includes a central axis of the wellbore tool string 1402 (the central axis may be represented by the broken line indicating the axial direction 1512).

A detonator holder 1518 and blast absorber 1520 may be positioned within the hollow interior 1508 of the second housing region 1408 of the first tool housing 1404, and a bulkhead 1516 may be provided in the first housing region 1414 of the second tool housing 1412. Similar to the blast absorber 1034 described hereinabove with reference to FIG. 10, the blast absorber 1520 illustrated in FIG. 15A includes a blast absorber inner wall 1522, a blast absorber outer wall 1524, and an opening 1526, which are configured substantially as described hereinabove with respect to FIG. 10. The detonator holder 1518 and the bulkhead 1516 are likewise configured substantially as described hereinabove with respect to FIG. 10. Thus, for purpose of convenience, and not limitation, the features and characteristics of the blast absorber 1520, the detonator holder 1518, and the bulkhead 1516 are not repeated here.

Figure 15B:
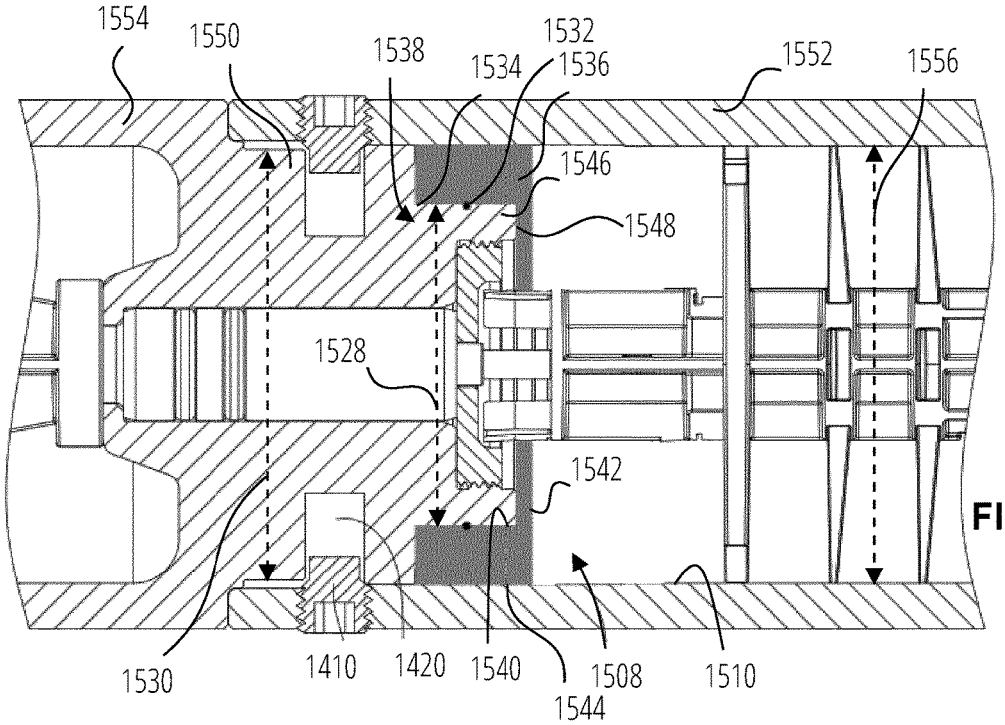
FIG. 15B is a partial cross-section view of a wellbore tool string according to an exemplary embodiment.

FIG. 15B shows a cross-section view of a wellbore tool string including a first tool housing 1552 connected to a second tool housing 1554 in accordance with the methods described herein, with a blast absorber 1536 positioned in the hollow interior 1508 of the first tool housing 1552. In the exemplary embodiment, the second tool housing 1554 may include a first housing region 1550 having a first outer diameter 1530 and an end portion 1546 having a third outer diameter 1528. The third outer diameter 1528 of the end portion 1546 may be smaller than the first outer diameter 1530 of the first housing region 1550. The blast absorber 1536 may include a blast absorber recess 1538 defined by a blast absorber recess wall 1540 that is configured to receive the end portion 1546 of the second tool housing 1554. A blast absorber outer wall 1544 may extend in parallel with the hollow interior surface 1510 of the first tool housing 1552 and may contact or be engaged with the hollow interior surface 1510 to secure a position of the blast absorber 1536 within the hollow interior 1508. A seal element 1532, such as an o-ring, may be provided between a third outer surface 1534 defining the end portion 1546 of the second tool housing 1554 and the blast absorber recess wall 1540, so that the blast absorber 1536 may be secured in position relative to the second tool housing 1554. A blast absorber inner wall 1542 may be provided as a planar surface extending radially inward from the blast absorber outer wall 1524, for example, along a hollow interior diameter 1556 of the hollow interior 1508. The blast absorber inner wall 1542 may be configured to prevent migration of debris, grime, soot, and the like from the hollow interior 1508 of the first tool housing 1552 into the connection mechanisms of the second tool housing 1554, as discussed above in connection with FIG. 10.

Figure 16:
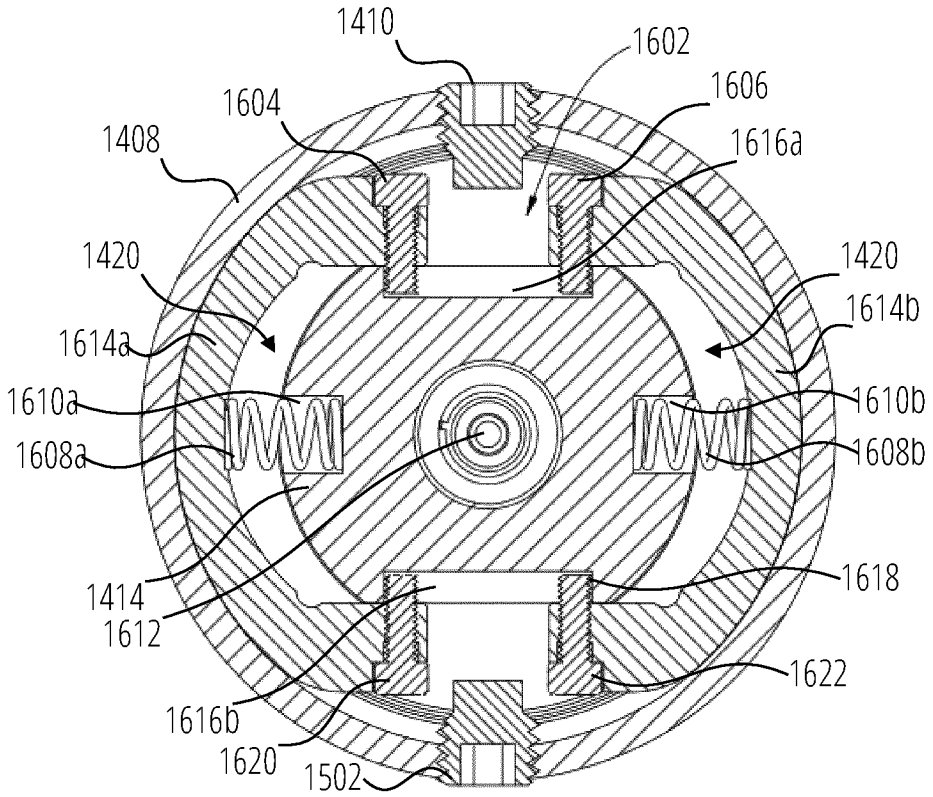
FIG. 16 is a transverse cross-section view of the wellbore tool string of FIG. 14A.

FIG. 16 shows a transverse cross-section view of the wellbore tool string 1402 of FIG. 14A. Bias member channel 1610*a*, 1610*b* may be provided in the first housing region 1414 extending inward in a radial direction (i.e., towards a center 1612 of the second tool housing 1412) from the first outer surface 1506 of the first housing region 1414. Bias member 1608*a*, 1608*b* may be provided within the bias member channel 1610*a*, 1610*b*. Snap connectors 1614*a*, 1614*b* may be engaged with the first housing region 1414 of the second tool housing 1412 to provide a connection assembly for connection to the first tool housing 1404.

Retainer screws 1604, 1606 may be inserted through screw holes provided in the end portion of each of the snap connector 1614*a*, 1614*b* and extend inward in a radial direction toward the center 1612 of the second tool housing 1412 into a recess 1616*a* formed in the first housing region 1414. In an aspect, a second recess 1616*b* may be provided in the first housing region 1414, which may be circumferentially spaced apart from the recess 1616*a*. The recess 1616*a*, 1616*b* may extend inward in the radial direction from the first outer surface 1506 of the first housing region 1414 and may be bound by a recess wall 1618. In an aspect, the second recess 1616*b* may be provided circumferentially opposite to the first recess 1616*a*. Each snap connector 1614*a*, 1614*b* may be engaged with a second retainer screw 1620, 1622 such that one retainer screw is engaged with each end portion of the snap connector. The second retainer screw 1620, 1622 of each snap connector may be provided in the second recess 1616*b*.

The first tool housing 1404 and second tool housing 1412 may be coupled together as described with reference to FIG. 6 and FIG. 10. A gap 1602 may be provided between the ends of snap connectors 1614*a*, 1614*a* radially adjacent to the recesses 1616*a*, 1616*b*. The bias members 1608*a*, 1608*b* may be compressed inward to allow passage of the snap connector 910*a*, 910*b* through the hollow interior 1508 of the first tool housing 1404, then subsequently bias the snap connector 910*a*, 910*b* outward to lock to the adjacent wellbore tool. The gap 1602 between the snap connectors 1614*a*, 1614*b* may enable radial movement of the snap connectors snap connector 1614*a*, 1614*b* and corresponding movement of the retainer screws 1604, 1606 during the coupling of the wellbore tool housings 1404, 1412 and formation of the wellbore tool string 1402.

FIG. 16 shows two bias member channels 1610*a*, 1610*b*, two bias members 1608*a*, 1608*b*, two snap connectors 1614*a*, 1614*b*, and two external screws 1410, 1502. However, it will be understood that the disclosure is not limited to two of these structures. For example, an exemplary embodiment may include a single one of each of the bias member channel 1610*a*, the bias member 1608*a*, the snap connector 1614*a*, and the external screw 1410. Alternatively, an exemplary embodiment may include three or more of each of the bias member channels 1610*a*, the bias members 1608*a*, the snap connectors 1614*a*, and the external screws 1410. These structures may be arranged symmetrically or asymmetrically around a circumference of the first tool housing 1404 and/or the second tool housing 1412.

In an aspect, the strength of the bias member 1608*a*, 1608*b* may be selected based on the needs of the application. In an exemplary embodiment, the strength of the bias member may be such that the bias member cannot be compressed by hand without the use of a tool. In an exemplary embodiment, the bias member 1608*a*, 1608*b* may be compressible by hand without the use of a tool. In an embodiment in which the bias member can be compressed by hand, use of an additional structure to prevent disassembly of the wellbore tool string, such as an external screw 1410, may be beneficial.

Exemplary embodiments of the disclosure may result in significant advantages over conventional devices. For example, the tool housings require less physical length for connecting wellbore tools in comparison with conventional threaded couplings or bayonet-twist couplings. The tool housings as described in the disclosure may be connected in a tool string without the use of threaded connections, pinned connections, or screwed connections. This allows the overall length of the tool string to be reduced, providing advantages in terms of gun length optimization. Additionally, exemplary embodiments of the tool housing may be assembled more efficiently and securely than conventional devices, and users can easily confirm secure coupling as well as ensure proper alignment between adjacent tools.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper,"

"lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while considering that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A wellbore tool connection assembly, comprising:

a tool housing comprising a first housing region having a first outer diameter and a second housing region having a second outer diameter, the second outer diameter being larger than the first outer diameter;

a bias member channel provided in the first housing region and extending inward in a radial direction from a first outer surface of the first housing region;

a bias member provided within the bias member channel;

a snap connector engaged with the bias member such that the bias member biases the snap connector outward in the radial direction;

a recess extending inward in the radial direction from the first outer surface of the first housing region, the recess being bound by a recess wall; and a retainer screw engaged with the snap connector and extending inward in the radial direction into the recess such that the bias member biases the retainer screw against the recess wall.

2. The wellbore tool connection assembly of claim 1, further comprising:

a hollow interior provided within the second housing region, the hollow interior being bound by a hollow interior surface having a hollow interior diameter greater than or equal to the first outer diameter;

a connector groove extending outward in the radial direction from the hollow interior surface, the connector groove having a groove diameter greater than the hollow interior diameter and less than the second outer diameter; and a release opening extending from a second outer surface of the second housing region to the connector groove.

3. The wellbore tool connection assembly of claim 2, further comprising:

a blast absorber provided in the hollow interior of the tool housing, the blast absorber comprising a blast absorber outer wall in contact with the hollow interior surface and a blast absorber inner wall extending radially inward from the blast absorber outer wall.

4. The wellbore tool connection assembly of claim 1, wherein:

the bias member channel is one of a plurality of bias member channels;

the bias member is one of a plurality of bias members, each bias member of the plurality of bias members being provided within a different bias member channel of the plurality of bias member channels; and the snap connector is one of a plurality of snap connectors, each snap connector of the plurality of snap connectors being engaged with a different bias member of the plurality of bias members.

5. The wellbore tool connection assembly of claim 1, wherein:

the retainer screw is one of two retainer screws;

the recess is one of a first recess and a second recess extending inward in the radial direction from the first outer surface of the first housing region, the two recesses circumferentially spaced apart from one another; and each retainer screw is engaged with the snap connector such that the bias member biases a first retainer screw against a recess wall of the first recess and a second retainer screw against a recess wall of the second recess.

6. The wellbore tool connection assembly of claim 1, wherein the retainer screw and the bias member intersect with a common plane that includes a central axis of the tool housing.

7. The wellbore tool connection assembly of claim 1, wherein the snap connector comprises a chamfer contact surface that is non-parallel with the radial direction.

* * * * *